US012338753B2

(12) United States Patent
Smart et al.

(10) Patent No.: US 12,338,753 B2
(45) Date of Patent: Jun. 24, 2025

(54) VARIABLE CAM TIMING PHASER

(71) Applicant: BorgWarner Inc., Auburn Hills, MI (US)

(72) Inventors: Michael Smart, Groton, NY (US); John C. Bulzacchelli, Dryden, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 18/388,982

(22) Filed: Nov. 13, 2023

(65) Prior Publication Data

US 2025/0154886 A1 May 15, 2025

(51) Int. Cl.
*F01L 1/344* (2006.01)

(52) U.S. Cl.
CPC ..... *F01L 1/3442* (2013.01); *F01L 1/344* (2013.01); *F01L 2001/34423* (2013.01)

(58) Field of Classification Search
CPC ..... F01L 1/3442; F01L 2001/34423; F01L 2001/34446; F01L 1/344; F01L 2001/3445
See application file for complete search history.

(56) References Cited

U.S. PATENT DOCUMENTS 6,374,788 B1 * 4/2002 Fukuhara ..... F01L 1/3442 123/90.17
6,748,912 B2 6/2004 Simpson et al.
9,021,997 B2 5/2015 Welte et al.
9,115,652 B2 8/2015 Choi et al.
9,366,162 B1 6/2016 Haltiner, Jr. et al.
10,329,967 B2 6/2019 Camilo et al.
10,858,968 B2 12/2020 Scheidig et al.
10,927,721 B2 2/2021 Mlinaric
11,168,591 B1 11/2021 Bulzacchelli et al.
11,193,400 B2 12/2021 Mlinaric
11,261,765 B1 3/2022 Plumeau et al.
2005/0098132 A1 * 5/2005 Kusano ..... F01L 1/3442 123/90.17
2008/0257288 A1 * 10/2008 Takahashi ..... F01L 1/3442 123/90.15
2012/0000437 A1 * 1/2012 Ozawa ..... F01L 1/3442 123/90.15

(Continued)

FOREIGN PATENT DOCUMENTS

EP 1371817 A2 * 12/2003 ..... F01L 1/022
JP 2018091342 A * 6/2018 ..... F01L 1/356
WO WO-2012094324 A1 * 7/2012 ..... F01L 1/3442

*Primary Examiner* — Wesley G Harris
(74) *Attorney, Agent, or Firm* — Howard & Howard Attorneys PLLC

(57) ABSTRACT

A variable cam timing phaser includes a housing and a rotor defining a plurality of chambers, a first end plate, and a second end plate. The variable cam timing phaser additionally includes at least one air vent located at a center of rotation region of at least one of the housing, the rotor, the first end plate, or the second end plate. The at least one air vent is fluidly coupled to the plurality of chambers and is configured to vent air from the plurality of chambers. The variable cam timing phaser also includes a reservoir fluidly coupled to the at least one air vent. The reservoir is configured to retain hydraulic fluid and is configured to reduce air from being ingested through the at least one air vent and into the plurality of chambers.

21 Claims, 19 Drawing Sheets

(56) References Cited

U.S. PATENT DOCUMENTS

| | | | | |
|---|---|---|---|---|
| 2015/0075461 | A1* | 3/2015 | Kato | F01L 1/3442<br>123/90.15 |
| 2020/0141288 | A1 | 5/2020 | Bruce et al. | |
| 2022/0412234 | A1 | 12/2022 | Karic | |
| 2023/0008355 | A1 | 1/2023 | Wing et al. | |

* cited by examiner

VARIABLE CAM TIMING PHASER

BACKGROUND OF THE DISCLOSURE

1. Field of the Disclosure

This invention relates generally to a variable cam timing phaser and a variable cam timing system including the same.

2. Description of the Related Art

In automobiles, internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But it is now possible to vary the angular position of the camshaft relative to the crankshaft using variable camshaft timing (VCT) technologies. VCT technologies can be implemented using VCT devices (sometimes referred to as camshaft phasers) that change the angular position of the camshaft relative to the crankshaft. These camshaft phasers are often hydraulically-actuated.

Variable cam timing phasers typically include a housing, a rotor, inner and outer plates, and a control valve, among other possible components. Hydraulic fluid in the form of oil is fed in and out of chambers defined by the housing, rotor, and plates in order to carry out advance and retard functionalities of the variable cam timing phaser. The control valve works to manage the oil as it flows in and out of the chambers and in response to instructions from an engine control unit (ECU).

In recent years, there has been a desire to limit air introduced into chambers defined by the housing and the rotor. However, current variable cam timing phasers fail to limit air introduced into the chambers. To this end, there remains a need for an improved variable cam timing phaser.

SUMMARY OF THE INVENTION

A variable cam timing phaser of a variable cam timing system, with the variable cam timing system including a camshaft, includes a housing having a housing wall disposed about an axis and defining a housing interior. The housing has a first housing side facing a first direction along the axis and a second housing side facing a second direction opposite the first direction. The variable cam timing phaser also includes a rotor disposed within the housing interior and moveable with respect to the housing. The rotor has a hub and a plurality of vanes extending from the hub away from the axis toward the housing wall. The rotor and the housing define a plurality of chambers with each chamber of the plurality of chambers having an advance chamber and a retard chamber. The variable cam timing phaser further includes a first end plate coupled to the first housing side and further defining the plurality of chambers, and a second end plate coupled to the second housing side and further defining the plurality of chambers. The variable cam timing phaser additionally includes at least one air vent located at a center of rotation region of at least one of the housing, the rotor, the first end plate, or the second end plate. The center of rotation region is defined as being relative to rotational motion of the variable cam timing phaser assembly. The air brought to the center of rotation region during use of the variable cam timing phaser and received in the at least one air vent escapes hydraulic fluid remaining in the variable cam timing phaser. The at least one air vent is fluidly coupled to the plurality of chambers and is configured to vent air from the plurality of chambers. The at least one air vent is defined by at least one of the rotor, the first end plate, the second end plate, and the housing. The variable cam timing phaser also includes a reservoir fluidly coupled to the at least one air vent. The reservoir is configured to retain hydraulic fluid and is configured to reduce air from being ingested through the at least one air vent and into the plurality of chambers.

BRIEF DESCRIPTION OF THE DRAWINGS

Other advantages of the present disclosure will be readily appreciated, as the same becomes better understood by reference to the following detailed description when considered in connection with the accompanying drawings.

DETAILED DESCRIPTION OF THE INVENTION

Figure 1:
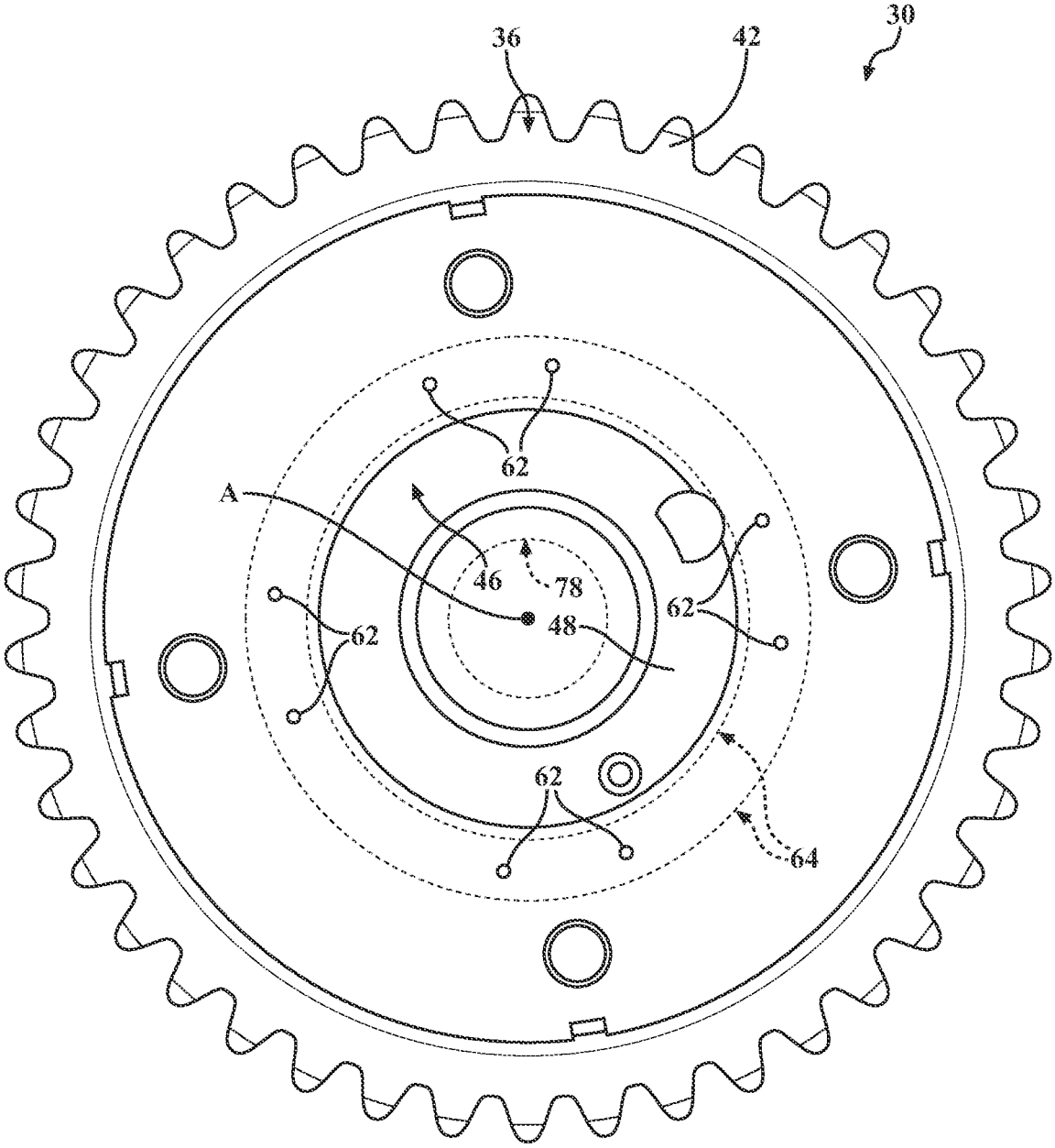
FIG. 1 is a front view of a variable cam timing phaser including a housing, a first end plate, and at least one air vent, with the air vent being defined by the first end plate.
Figure 2:
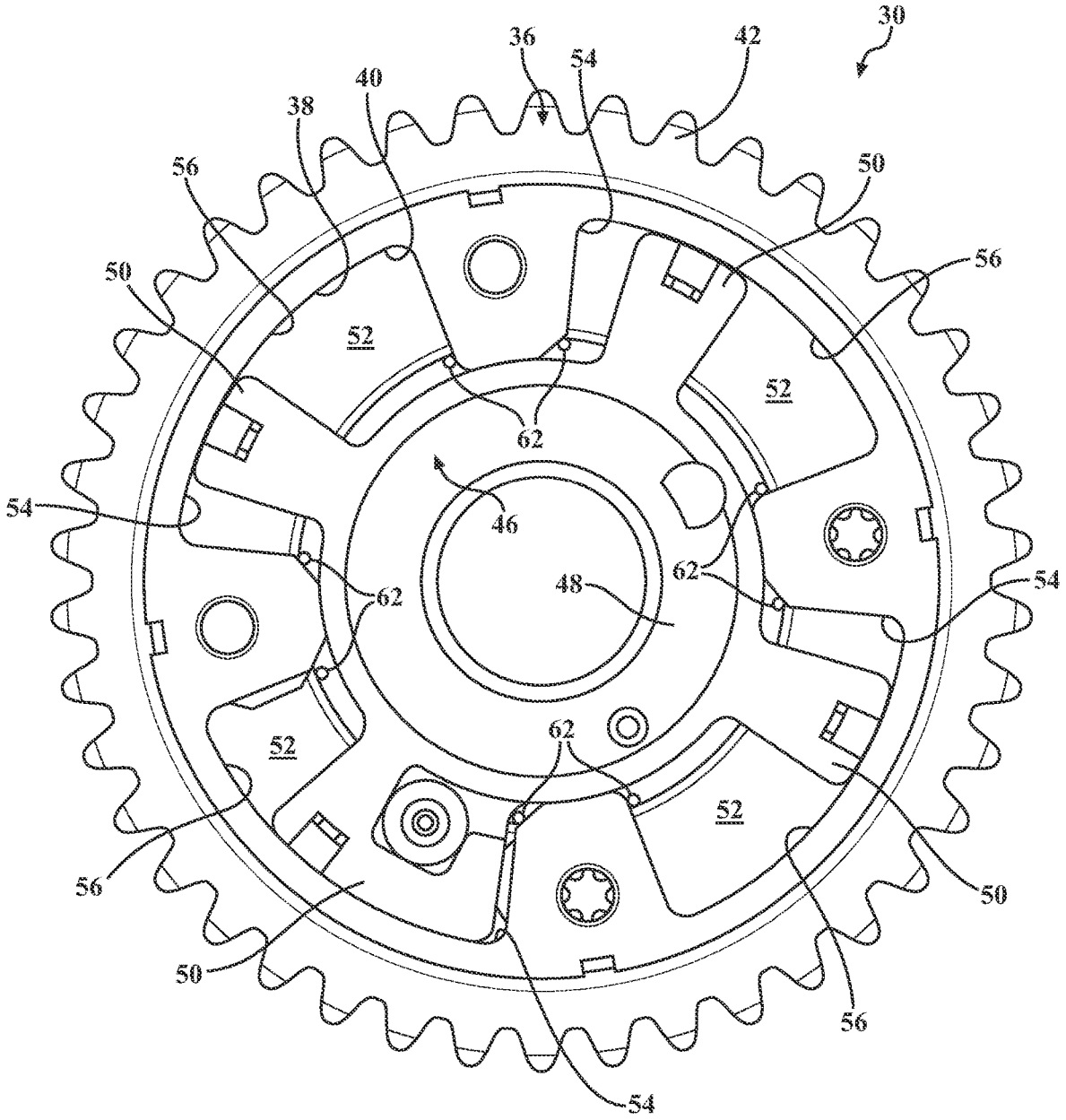
FIG. 2 is a front view of the variable cam timing phaser of FIG. 1, with the first end plate being transparent for demonstrative purposes, and with the variable cam timing phaser including a rotor, with the housing and the rotor defining a plurality of chambers.
Figure 3:
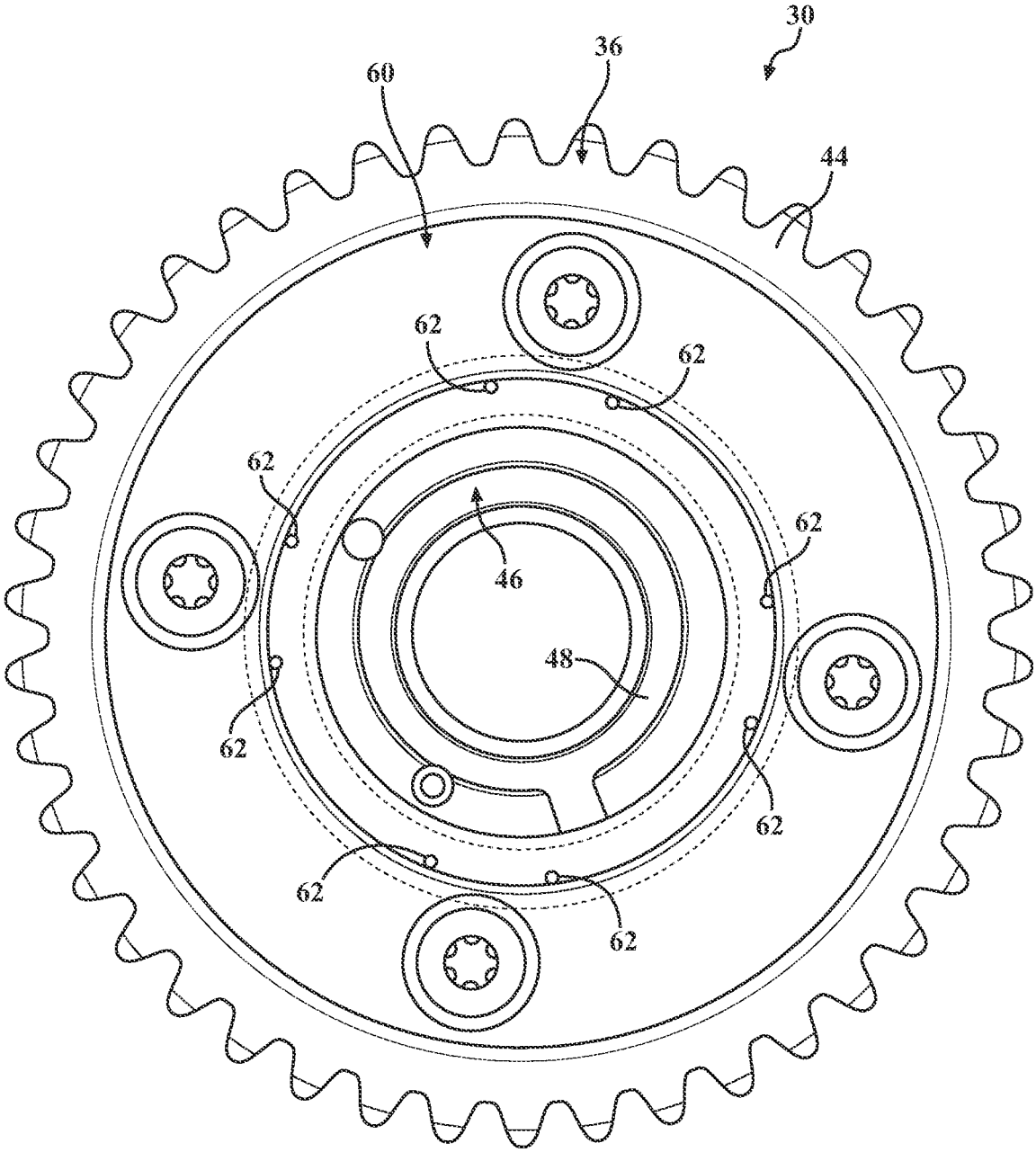
FIG. 3 is a rear view of the variable cam timing phaser further including a second end plate, and with the at least one air vent being defined by the second end plate.
Figure 4:
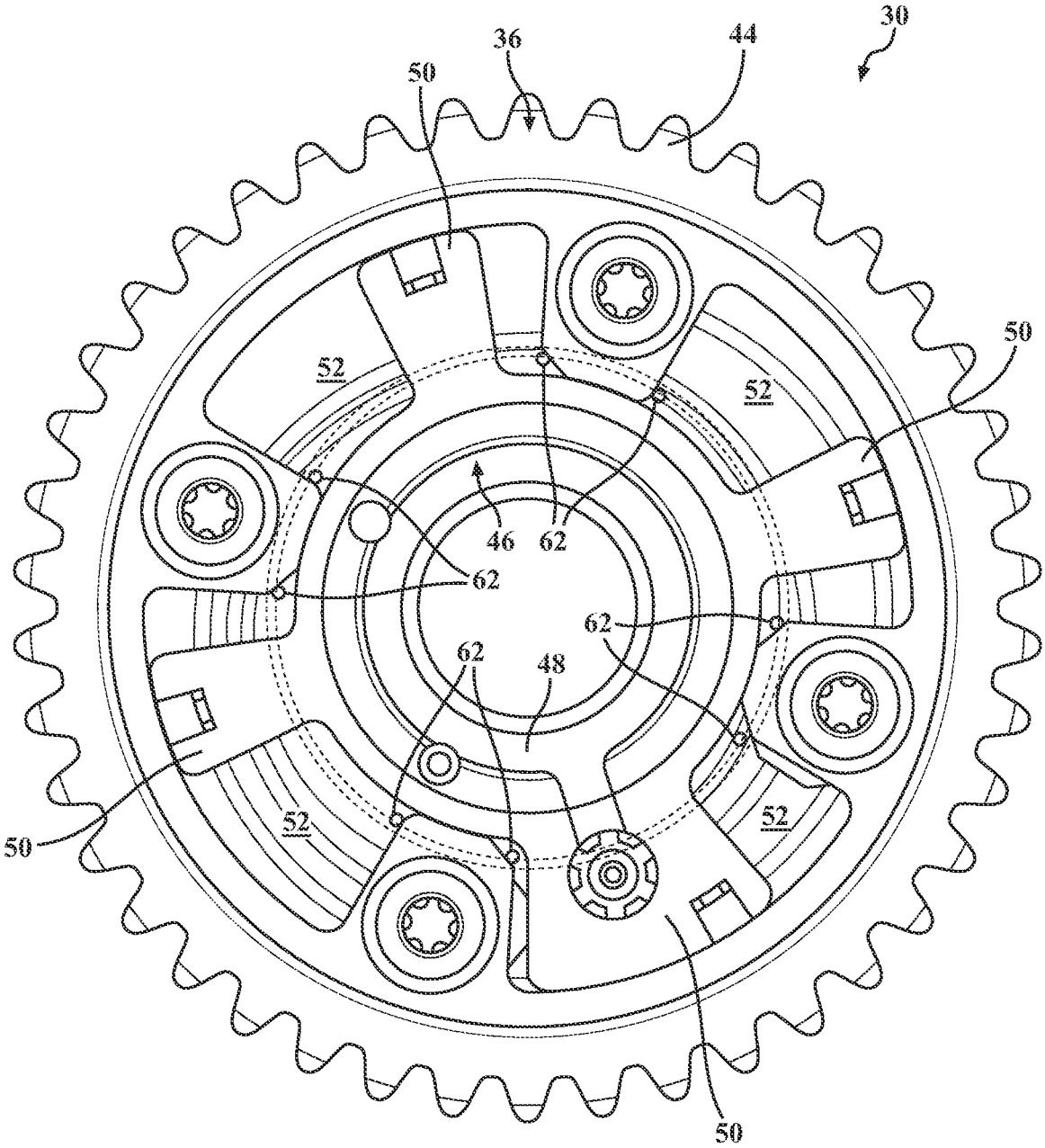
FIG. 4 is a rear view of the variable cam timing phaser of FIG. 3, with the second end plate being transparent for demonstrative purposes.
Figure 5:
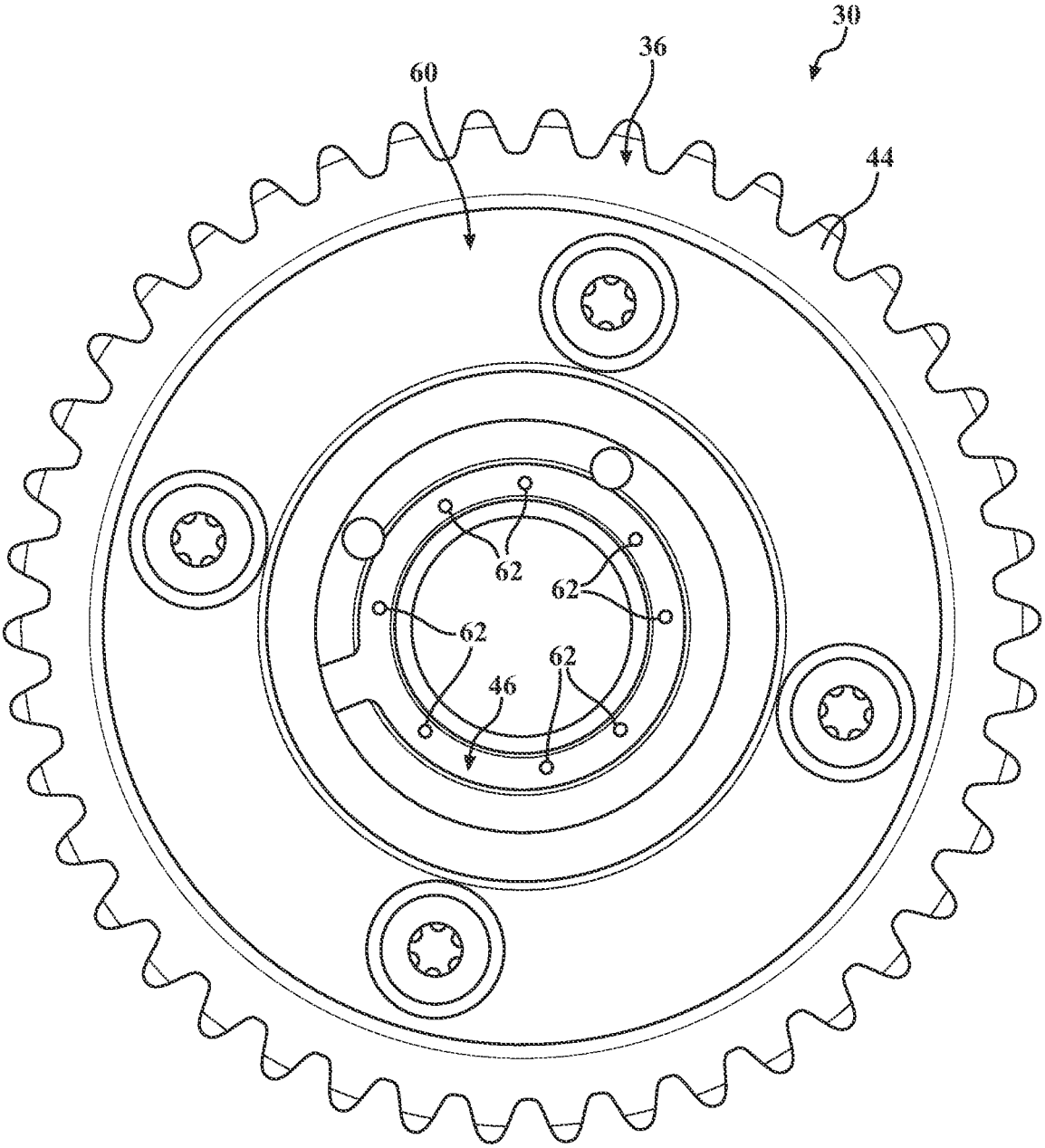
FIG. 5 is a rear view of the variable cam timing phaser, with the at least one air vent being defined by the rotor.
Figure 6:
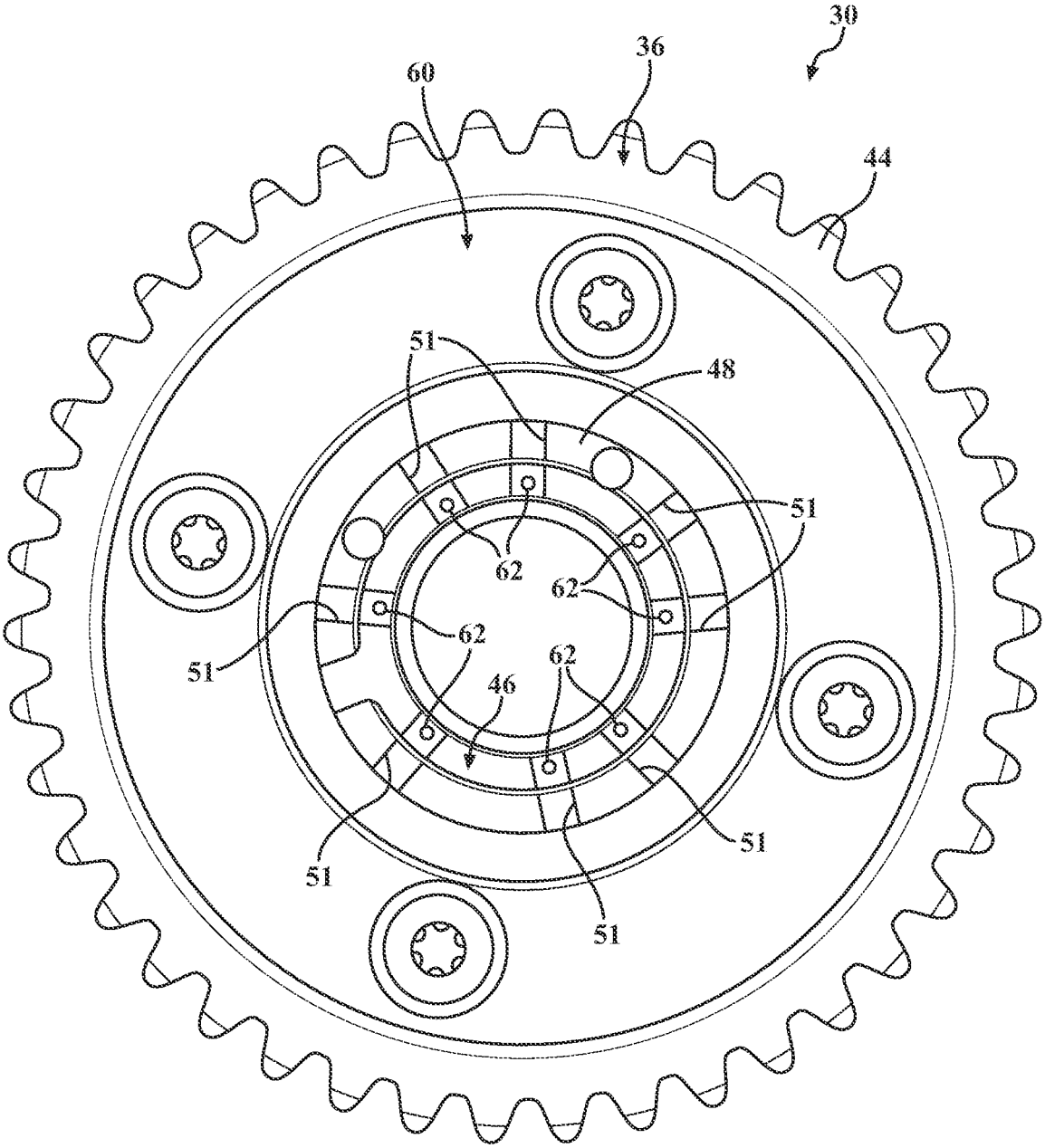
FIG. 6 is a rear view of the variable cam timing phaser of FIG. 5, with the rotor being partially transparent for demonstrative purposes.
Figure 7:
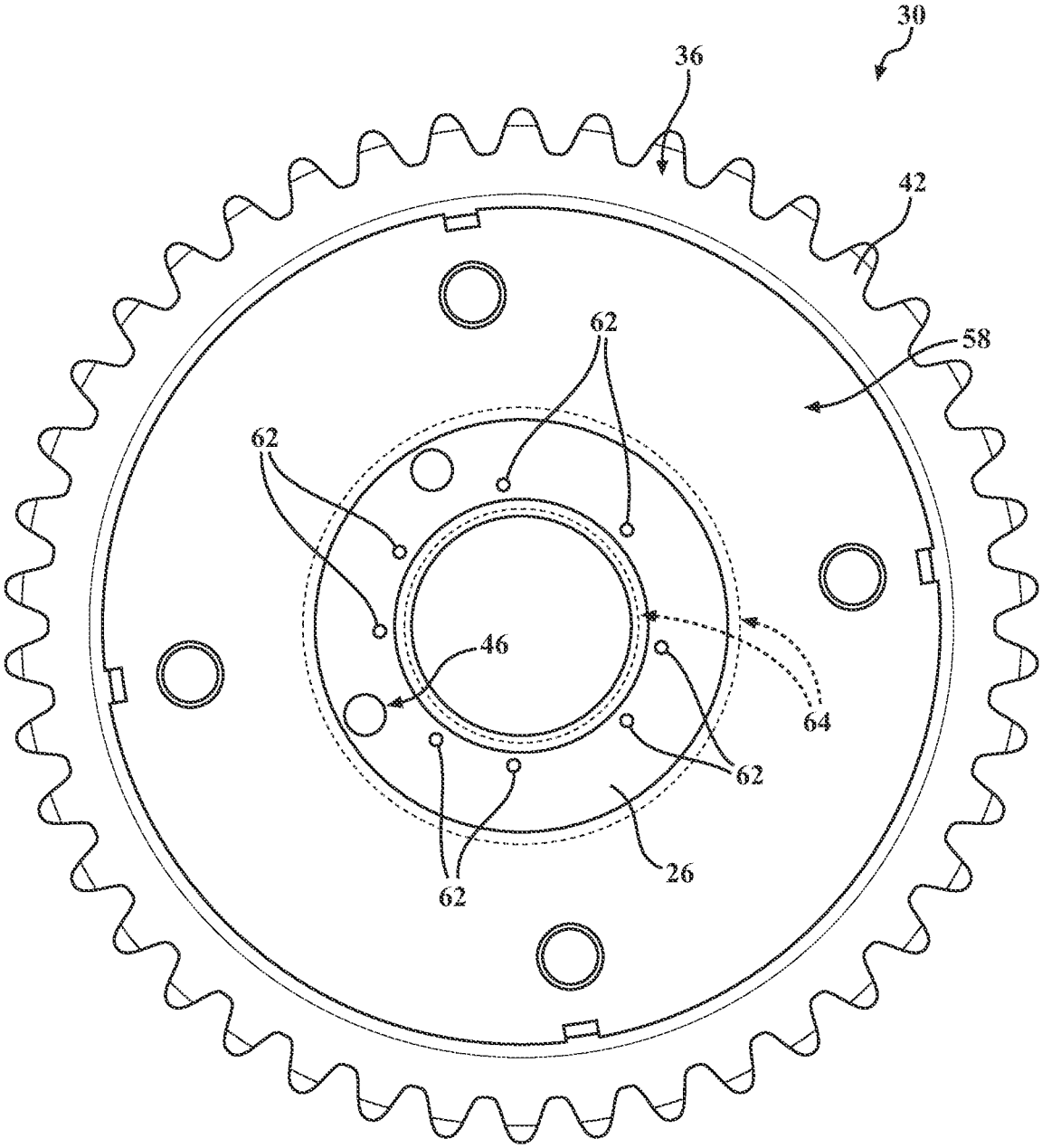
FIG. 7 depicts a front view of the variable cam timing phaser of FIG. 5.
Figure 8:
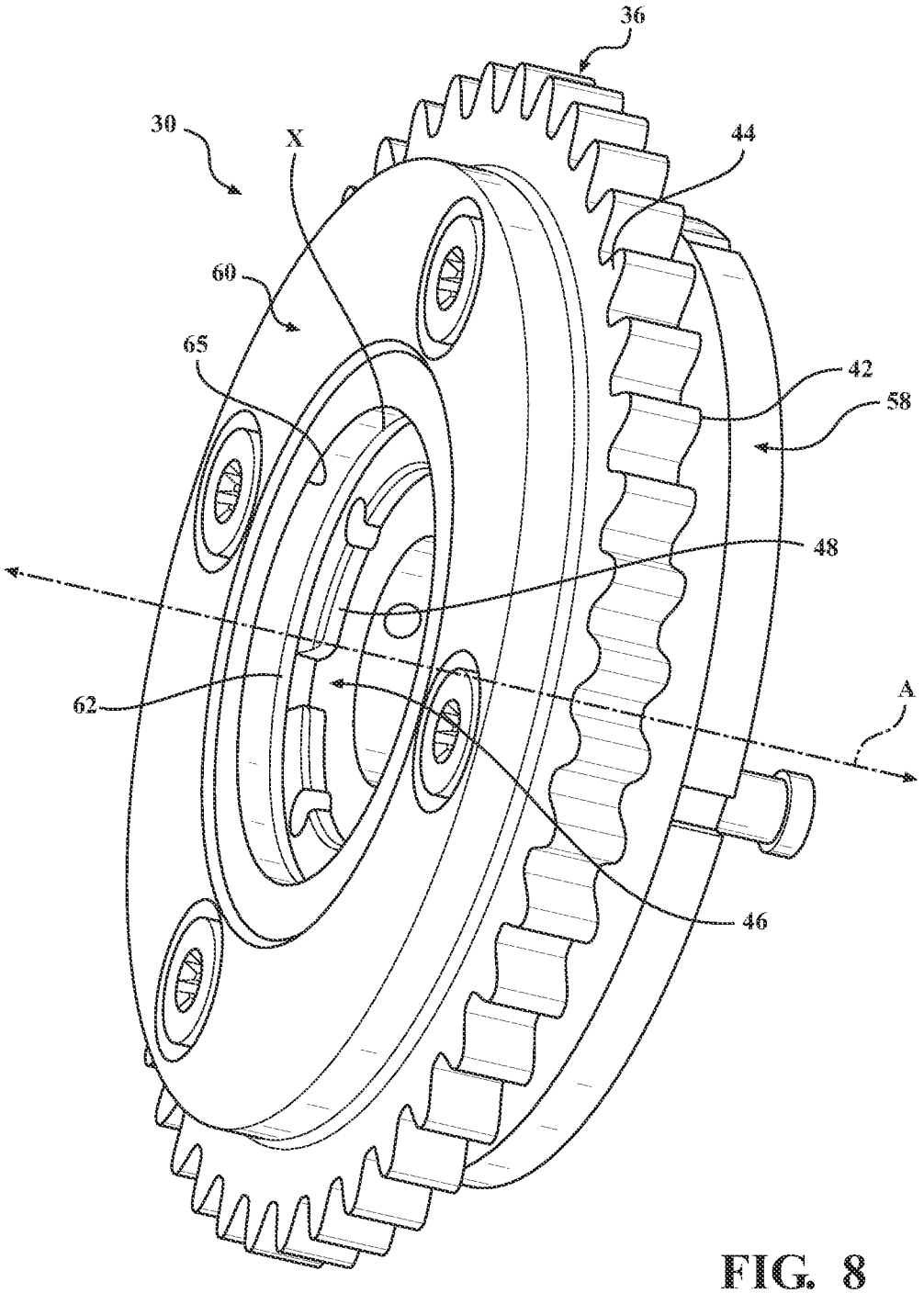
FIG. 8 depicts a perspective view of the variable cam timing phaser, with the at least one air vent being in the form of a clearance between the second end plate and the rotor.
Figure 9:
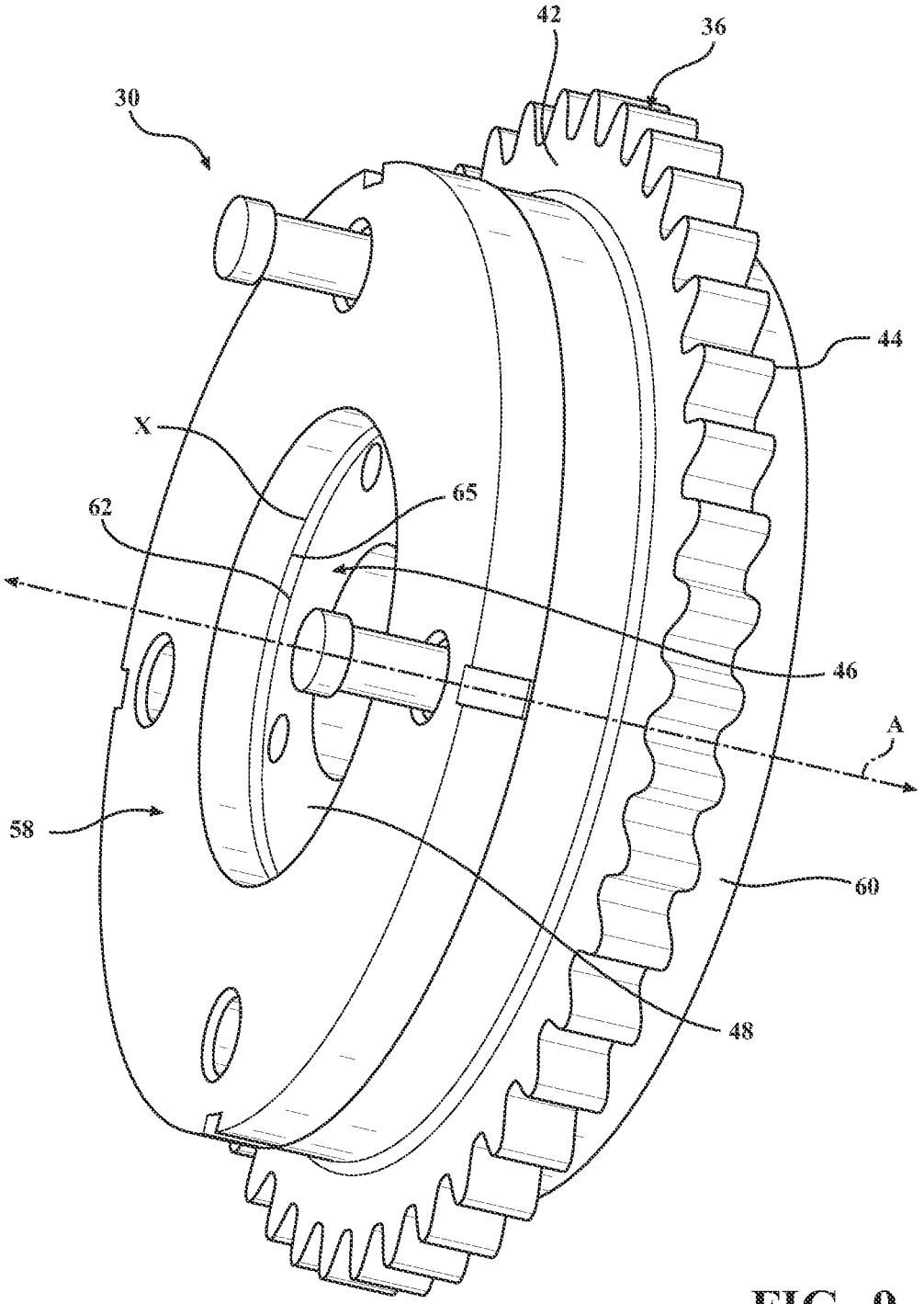
FIG. 9 depicts a perspective view of the variable cam timing phaser, with the at least one air vent being in the form of a clearance between the first end plate and the rotor.
Figure 10:
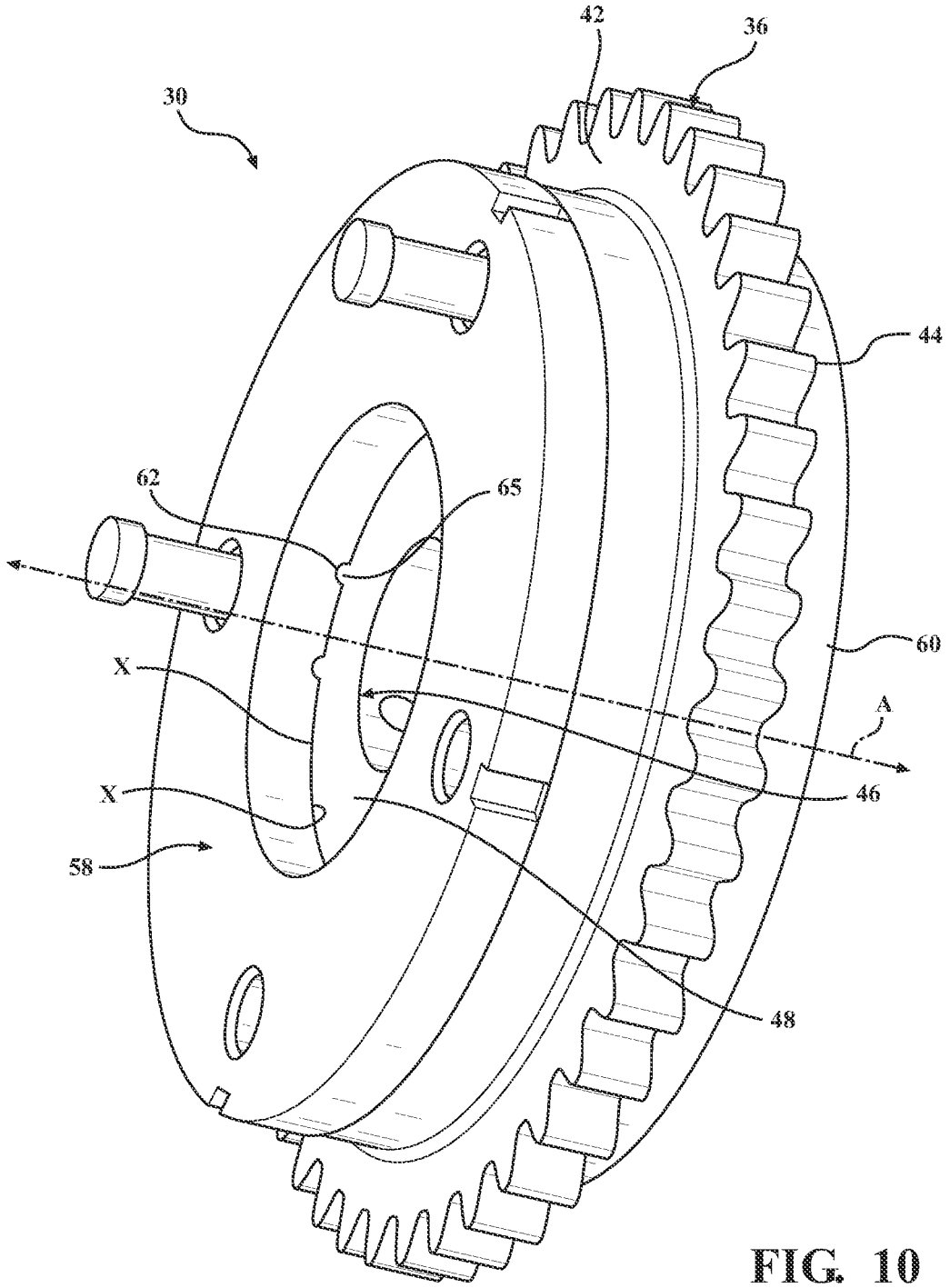
FIG. 10 depicts a perspective view of the variable cam timing phaser, with the at least one air vent being in the form of a clearance between the first end plate and the rotor.
Figure 11:
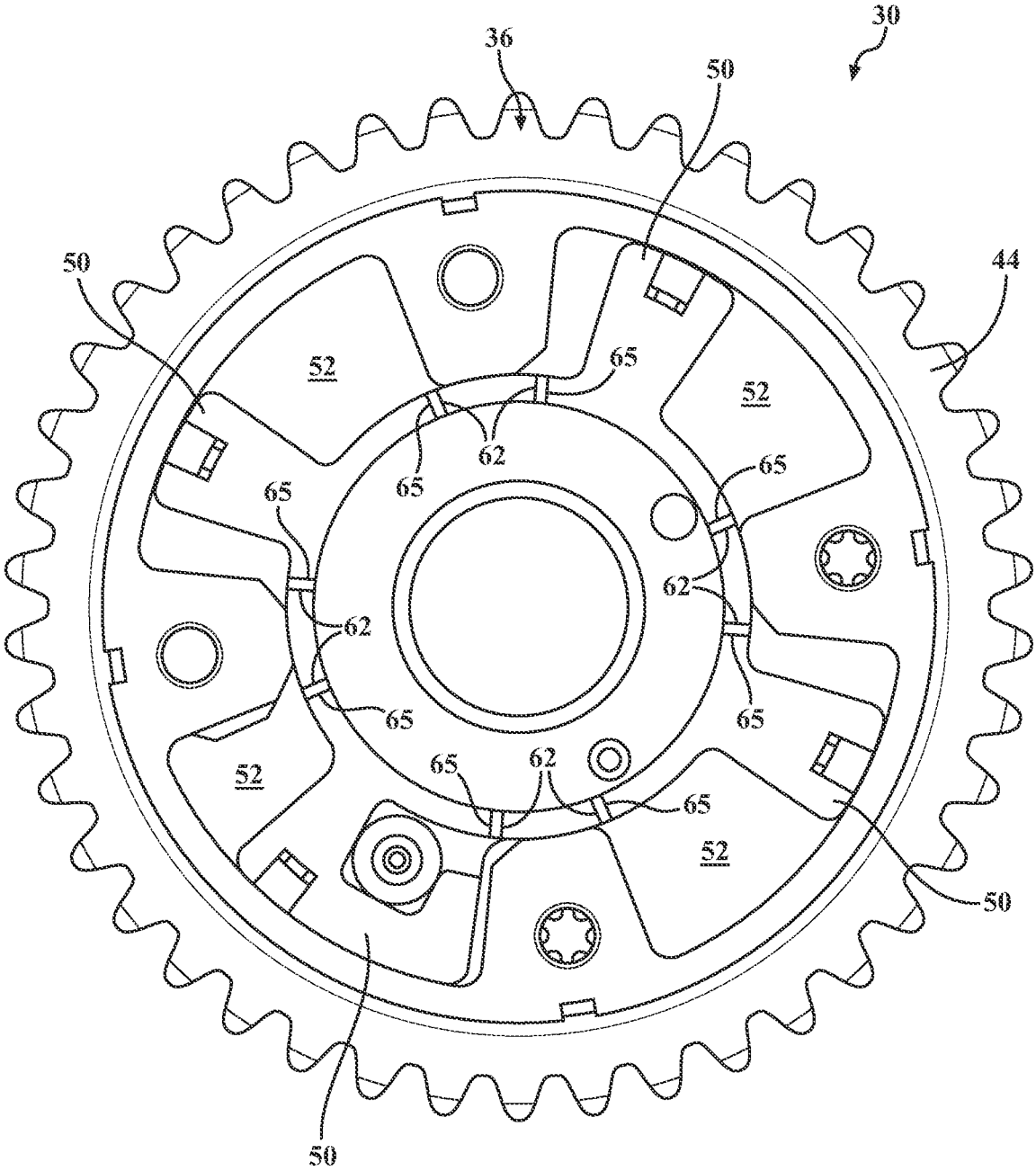
FIG. 11 depicts the variable cam timing phaser of FIG. 10, with the first end plate being partially transparent for demonstrative purposes.
Figure 12A:
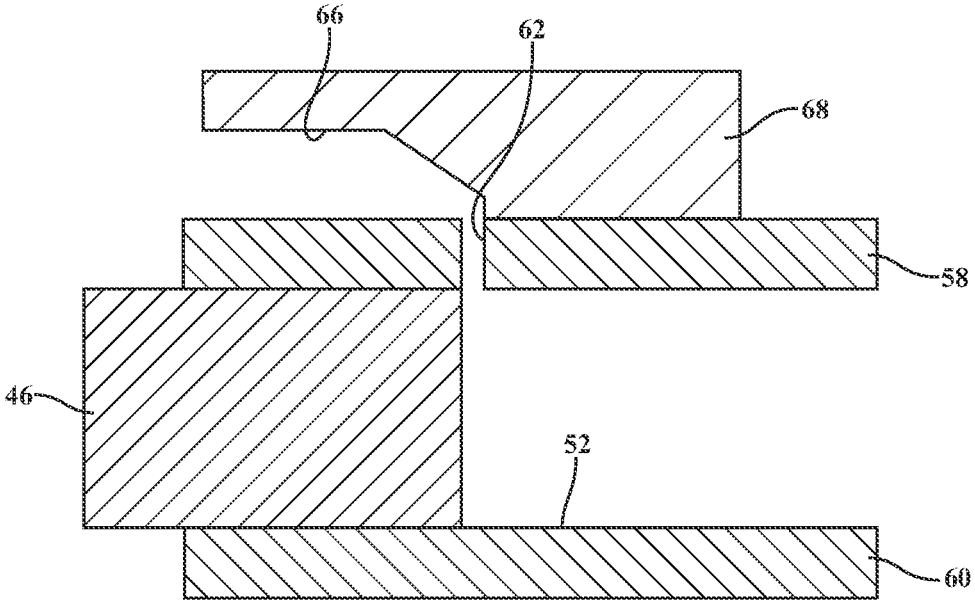
FIG. 12A is a cross-sectional view of the variable cam timing phaser further including a ring coupled to the first end plate, with the ring defining the reservoir and the first end plate defining the air vent.
Figure 12B:
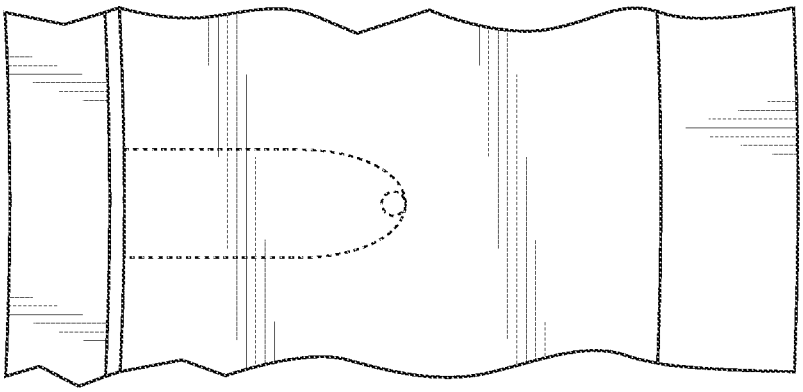
FIG. 12B is a top view of the ring, the air vent, and the reservoir of FIG. 12A.
Figure 20:
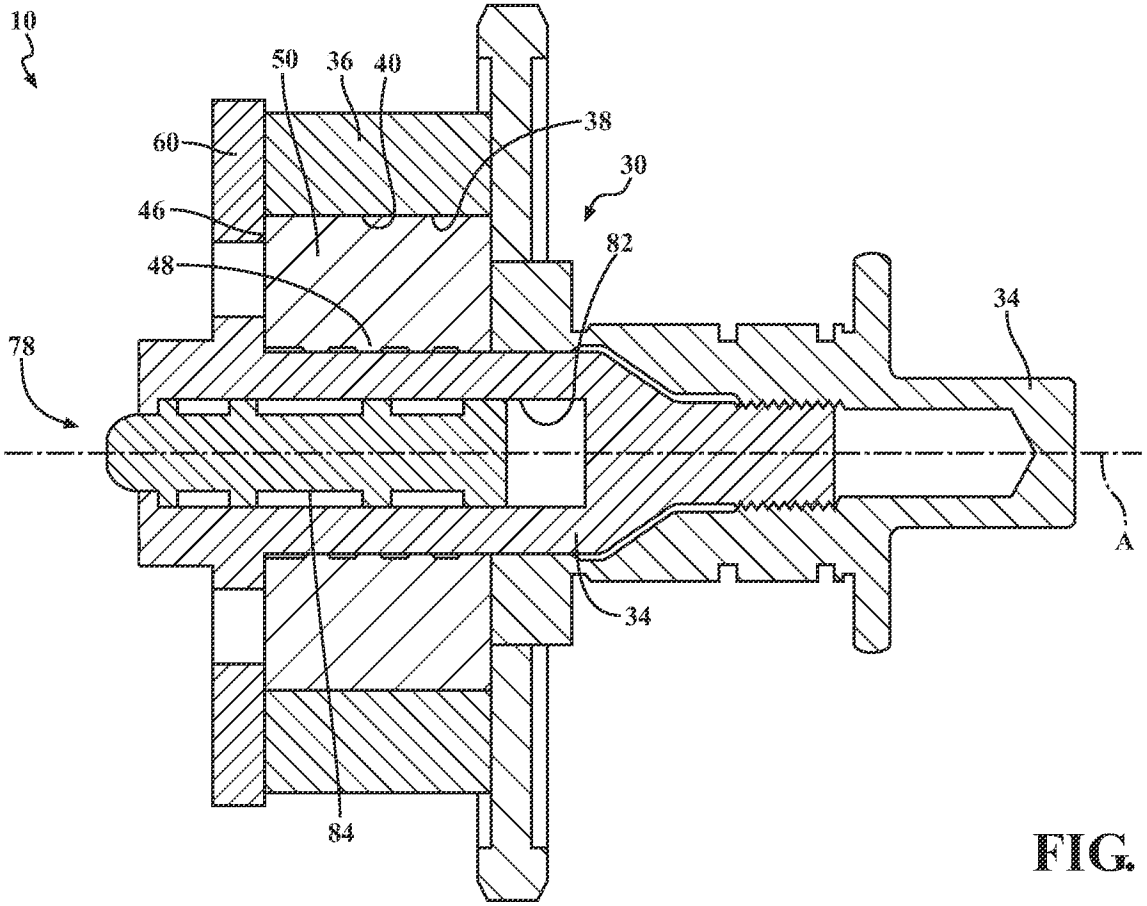
FIG. 20 is a side cross-sectional view of the variable cam timing system including the variable cam timing phaser, a camshaft, and a control valve.

With reference to the Figures, wherein like numerals indicate like parts throughout the several views, a variable cam timing phaser 30 is generally shown in FIGS. 1-11. A variable cam timing system 32, as shown in FIG. 20, may include the variable cam timing phaser, with the variable cam timing system 32 also including a camshaft 34. As shown in FIGS. 1-11, the variable cam timing phaser 30 includes a housing 36 having a housing wall 38 disposed about an axis A and defining a housing interior 40. The housing 36 has a first housing side 42, as shown in FIGS. 1, 2, 7-10, facing a first direction along the axis A and a second housing side 44, as shown in FIGS. 3-6 and 8-11, facing a second direction opposite the first direction. The variable cam timing phaser 30 also includes a rotor 46 disposed within the housing interior 40 and moveable with respect to the housing 36. The rotor 46 has a hub 48 and a plurality of vanes 50 extending from the hub 48 away from the axis A toward the housing wall 38. The rotor 46 and the housing 36 define a plurality of chambers 52 with each chamber 52 of the plurality of chambers 52 having an advance chamber 54 and a retard chamber 56, as shown in FIG. 2. The hub 48 may define a plurality of ports 51, as shown in FIG. 6.

The variable cam timing phaser 30 also includes a first end plate 58 coupled to the first housing side 42 and further defining the plurality of chambers 52, and a second end plate 60 coupled to the second housing side 44 and further defining the plurality of chambers 52. It is to be appreciated that in the context of this disclosure, when the first end plate 58 is coupled to the first housing side 42, the first end plate 58 may be integral (i.e., on piece) with the housing 36 or the first end plate 58 may be a separate component from the housing 36. Similarly, it is to be appreciated that in the context of this disclosure, when the second end plate 60 is coupled to the second housing side 44, the second end plate 60 may be integral (i.e., on piece) with the housing 36 or the second end plate 60 may be a separate component from the housing 36. The variable cam timing phaser 30 additionally includes at least one air vent 62 located at a center of rotation region 64 of at least one of the housing 36, the rotor 46, the first end plate 58, or the second end plate 60. The center of rotation region 64 is defined as being relative to rotational motion of the variable cam timing phaser 30. For example, the center of rotation region 64 may be relative to that of the first end plate 58 and its positional relationship with the hub 48, and is approximated and represented in FIG. 1 by the broken circles depicted. The center of rotation region 64 may coincide with a radially-inboard region of the chambers 52 and may reside adjacent the hub 48 of the rotor 46. Air removal and purging of air is effective and efficient at the center of rotation region 64. Furthermore, the at least one air vent 62, and numerous air vents 62, may be located at corners or corner regions of the chambers 52. For example, a single air vent 62 may be located at each corner of each of the chambers 52. Moreover, in some embodiments, with respect to their particular location on the first end plate 58, the air vents 62 may reside at circumferential and radial locations to fluidly communicate with the established fluid chambers 52.

During use of the variable cam timing phaser 30, air may be brought to the center of rotation region 64 and received in the at least one air vent 62 by escaping hydraulic fluid that remains in the variable cam timing phaser 30. The at least one air vent 62 is fluidly coupled to the plurality of chambers 52 and is configured to vent air from the plurality of chambers 52. The at least one air vent 62 is defined by at least one of the rotor 46, the first end plate 58, the second end plate 60, and the housing 36. In one embodiment, the at least one air vent 62 is in direct fluid communication with the plurality of chambers 52. Description of the at least one air vent can be found in U.S. Pat. No. 11,168,591, the disclosure of which is incorporated by reference in its entirety.

The at least one air vent 62 may be fluidly coupled to the advance chamber 54, or the at least one air vent 62 may be fluidly coupled to the retard chamber 56. It is to be appreciated that the variable cam timing phaser 30 may have two or more vents 62, with each vent being associated with one chamber 52 and, more typically, two vents 62 per one chamber 52. In one embodiment, as shown in FIGS. 8-11, the at least one air vent 62 is further defined as at least one clearance 65 defined between at least one of the first end plate 58 or second end plate 60 and the hub 48 of the rotor 46.

With reference to FIGS. 12A-19, the variable cam timing phaser 30 additionally includes a reservoir 66 fluidly coupled to the at least one air vent 62. The reservoir 66 may be configured to be at, or near, atmospheric pressure. It is to be appreciated that atmospheric pressure may refer to the pressure inside a crankcase of the internal combustion engine or may be the pressure of ambient air. The reservoir 66 is configured to retain hydraulic fluid and is configured to reduce air from being ingested through the at least one air vent 62 and into the plurality of chambers 52. The variable cam timing phaser 30 including the reservoir 66 offers several advantages. First, the reservoir 66 retains hydraulic fluid during operation of the variable cam timing phaser 30 in which the variable cam timing phaser 30 is spinning about the axis A. Typically, this hydraulic fluid is from leakage of hydraulic fluid from the air vents 62 to the active chamber (either advance chamber 54 or retard chamber 56). During the spinning of the variable cam timing phaser 30, the at least one air vent 62 vents into the reservoir 66, rather than communicating directly with the atmosphere. The reservoir 66 typically communicates with, i.e., is fluidly coupled to, the at least one air vent 62 at its maximum radius from the axis A, and the reservoir 66 typically communicates with, i.e., is fluidly coupled to, the atmosphere at its minimum radius from the axis A. During most operating speeds, the centripetal acceleration is greater than the acceleration due to gravity, which then allows the reservoir 66 to retain hydraulic fluid. Additionally, during rotation of the variable cam timing phaser 30, the dominant buoyant force acting on any air bubbles in the reservoir is toward the axis A. Meanwhile, the hydraulic fluid in the reservoir 66 will cause any air bubbles to move toward the center axis A due to the lower density of the air bubbles than the hydraulic fluid. When air is pushed out of the active chamber (either the advance chamber 54 or the retard chamber 56), the air is forced to escape through the air vent 62 into the reservoir 66. As the air moves into the reservoir 66, the air tends to move toward the axis A and away from the air vent 62, which results in the variable cam timing phaser 30 being more likely to draw oil from the reservoir 66 rather than air during a low pressure event in which the pressure in the active chamber of the advance chamber 54 and retard chamber 56 is lower than the atmospheric pressure, such as pressure in the crankcase or of the ambient air.

The variable cam timing phaser 30 may be free of a check valve disposed in the air vent 62. In one embodiment, the variable cam timing phaser 30 is free of a mechanical check valve that moves between an open position for allowing air and hydraulic fluid to flow through the air vent 62, and a close position for restricting air and hydraulic fluid from flowing through the air vent 62.

As shown in FIGS. 12A-14, the variable cam timing phaser 30 may further include a ring 68 coupled to the first end plate 58, with the ring 68 defining the reservoir 66 and, optionally, the ring 68 and the first end plate 58 defining the reservoir 66. The reservoir 66 may be machined into the ring 68. When hydraulic fluid and air is pushed out of the active chamber (either the advance chamber 54 or the retard chamber 56), both the hydraulic fluid and air may flow into the reservoir 66. The centrifugal force would tend to trap the hydraulic fluid into the reservoir 66, whereas air (such as air bubbles) would tend to move toward the axis A due to its lower density than hydraulic fluid. The reservoir 66 may be fluidly coupled to the atmosphere, which allows the air to empty into the atmosphere, and allows the hydraulic fluid to flow into the chamber 52 during a low pressure event in which the pressure in the active chamber of the advance chamber 54 and retard chamber 56 is lower than the atmospheric pressure, such as pressure in the crankcase or of the ambient air, rather than drawing air back into the chamber 52. In the embodiment shown in FIGS. 12A-14, the first end plate 58 may define the at least one air vent 62.

Figure 13A:
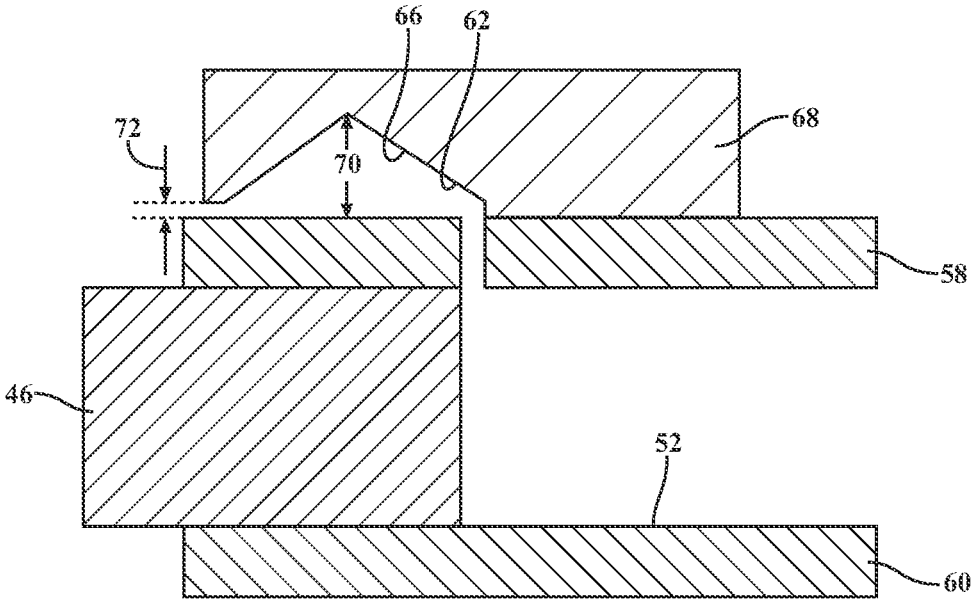
FIG. 13A is a cross-sectional view of another embodiment of the ring of FIG. 12A, with the reservoir having a first ring cross-sectional flow area and a second ring cross-sectional flow area, and with the second ring cross-sectional flow area being less than the first ring cross-sectional flow area.
Figure 13B:
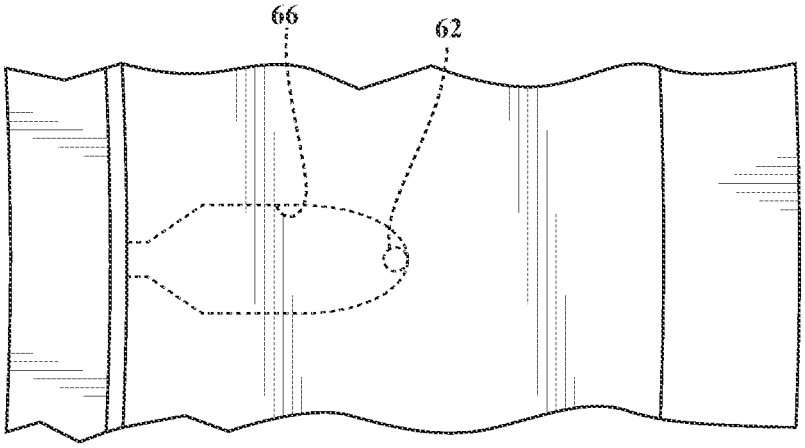
FIG. 13B is a top view of the ring, the air vent, and the reservoir of FIG. 13A.
Figure 14:
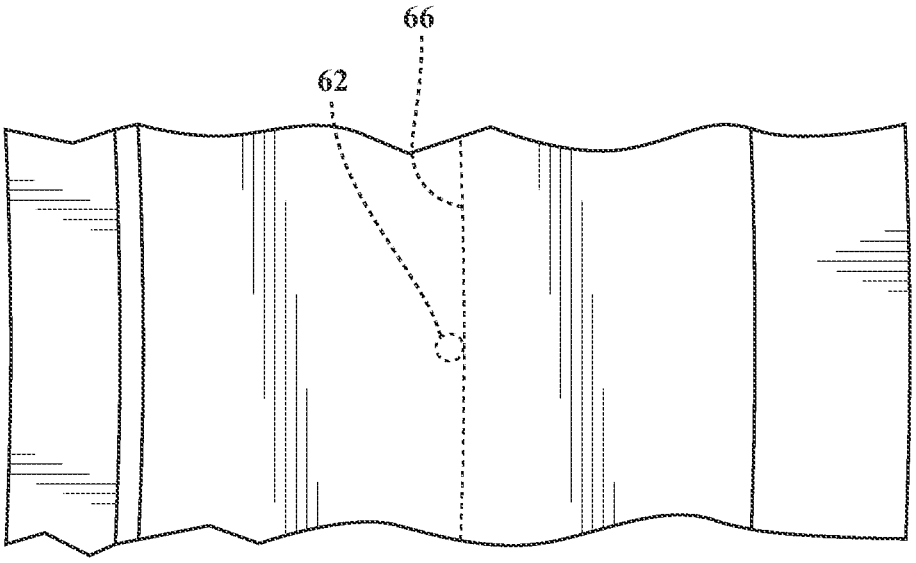
FIG. 14 is a top view of the ring, the air vent, and the reservoir, with the reservoir being defined 360 degrees about an axis of the housing.

As shown in FIG. 13A, the reservoir 66 has a first ring cross-sectional flow area 70 and a second ring cross-sectional flow area 72, with the second ring cross-sectional flow area 72 being less than the first ring cross-sectional flow area 70. Having the second ring cross-sectional flow area 72 being less than the first ring cross-sectional flow area 70 increases the time required to drain the reservoir 66 if the centrifugal force reduces to the point where hydraulic fluid is drained from the reservoir 66. When the ring 68 and the first end plate 58 define the reservoir 66, the reservoir 66 may be defined 360 degrees about the axis A, as shown in FIG. 14. In such embodiments, the at least one air vent 62 is further defined as a plurality of air vents 62, and each of the air vents 62 are fluidly coupled to the plurality of chambers 52 and are configured to vent air from said plurality of chambers 52. Then, during operation of the variable cam timing phaser 30, the air vents 62 all discharge air into the reservoir 66 that is defined 360 degrees about the axis A.

Figure 15A:
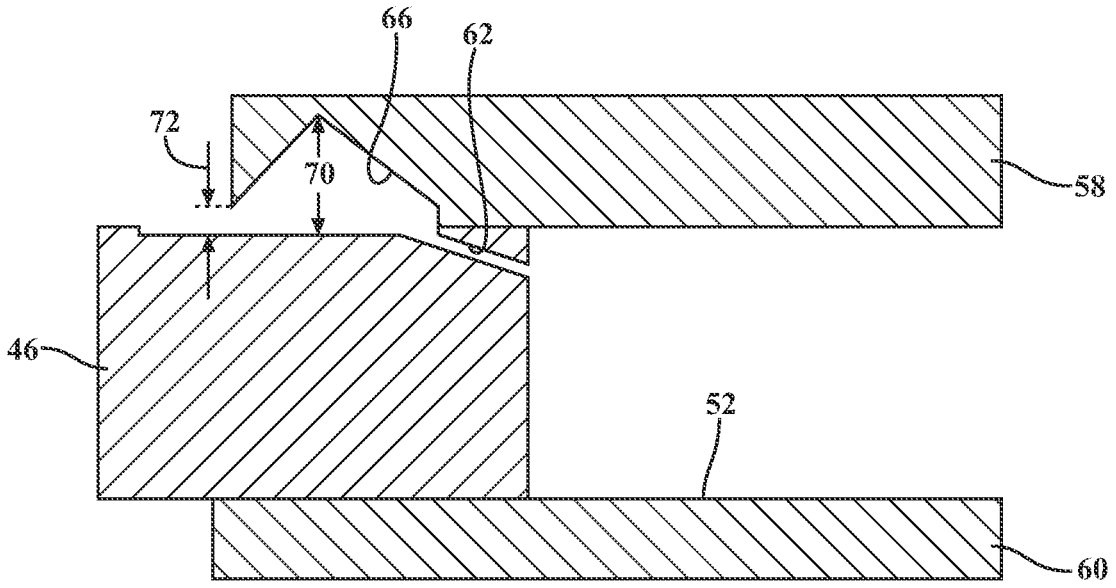
FIG. 15A is a cross-sectional view of another embodiment of the variable cam timing phaser, with the first end plate defining the reservoir and the rotor defining the air vent.
Figure 15B:
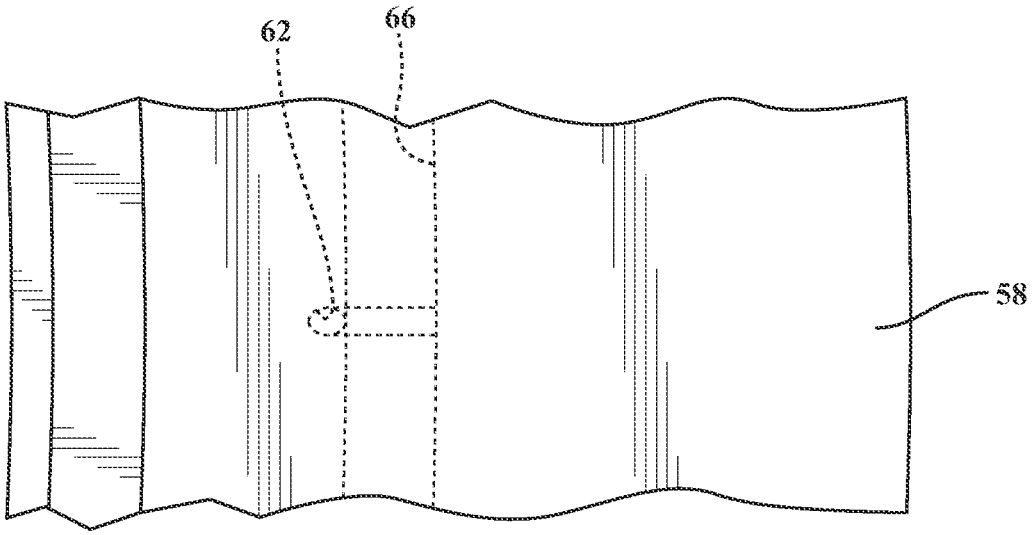
FIG. 15B is a top view of the rotor, the first end plate, the reservoir, and the rotor of FIG. 15A.

In another embodiment, as shown in FIGS. 15A and 15B, the first end plate defines the reservoir 66. In such embodiments, the rotor 46 may define the at least one air vent 62. The reservoir 66 may be defined 360 degrees about the axis. In such embodiments, the at least one air vent 62 is further defined as a plurality of air vents 62, and each of the air vents 62 are fluidly coupled to the plurality of chambers 52 and are configured to vent air from the plurality of chambers 52. Then, during operation of the variable cam timing phaser 30, the air vents 62 all discharge air into the reservoir 66 that is defined 360 degrees about the axis A.

Figure 16A:
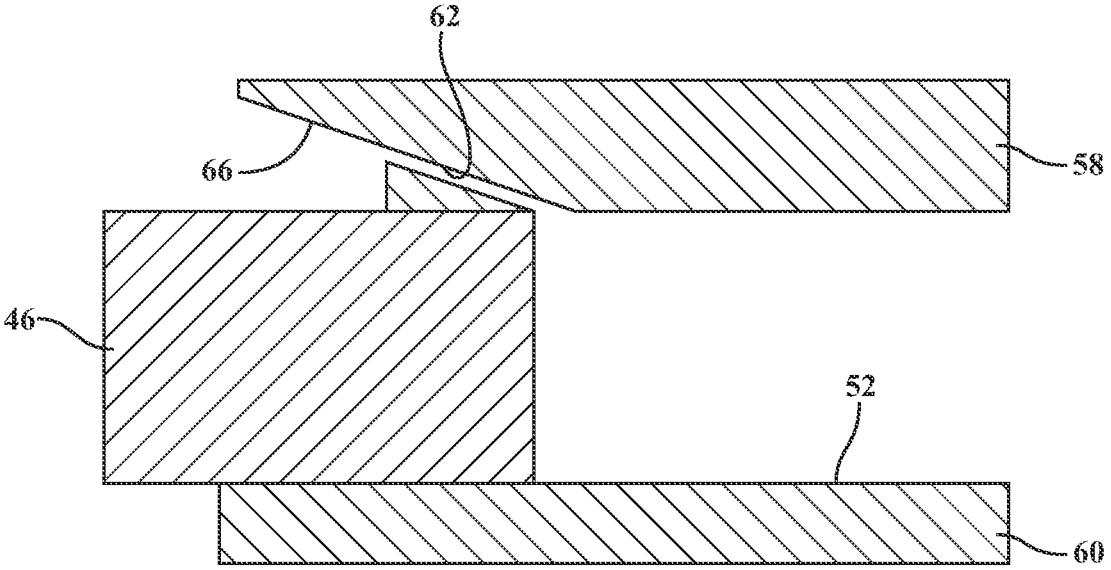
FIG. 16A is a cross-sectional view of another embodiment of the variable cam timing phaser, with the reservoir being defined by the first end plate and the rotor, and with the air vent being defined by the first end plate.
Figure 16B:
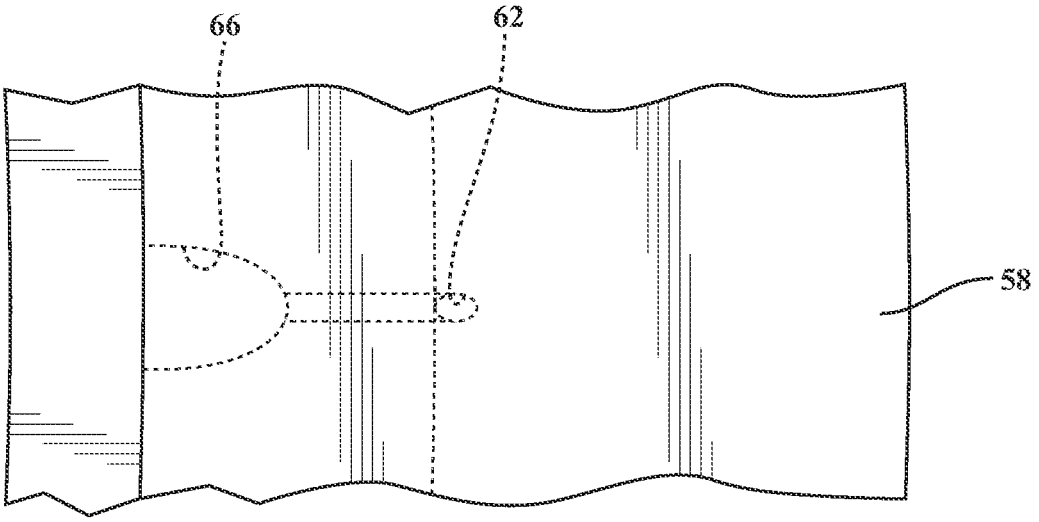
FIG. 16B is a top view of the rotor, the first end plate, the reservoir, and the air vent of FIG. 16A.

In yet another embodiment, as shown in FIGS. 16A and 16B, the rotor 46 and the first end plate 58 define the reservoir 66. In such embodiments, the first end plate 58 may define the at least one air vent 62. In this embodiment, the first end plate 58 and the rotor 46 may be formed by a net shape process in which the components are pressed and sintered powdered metal, which typically reduces the cost of the first end plate 58 and the rotor 46 and, in turn, the variable cam timing phaser 30.

Figure 17A:
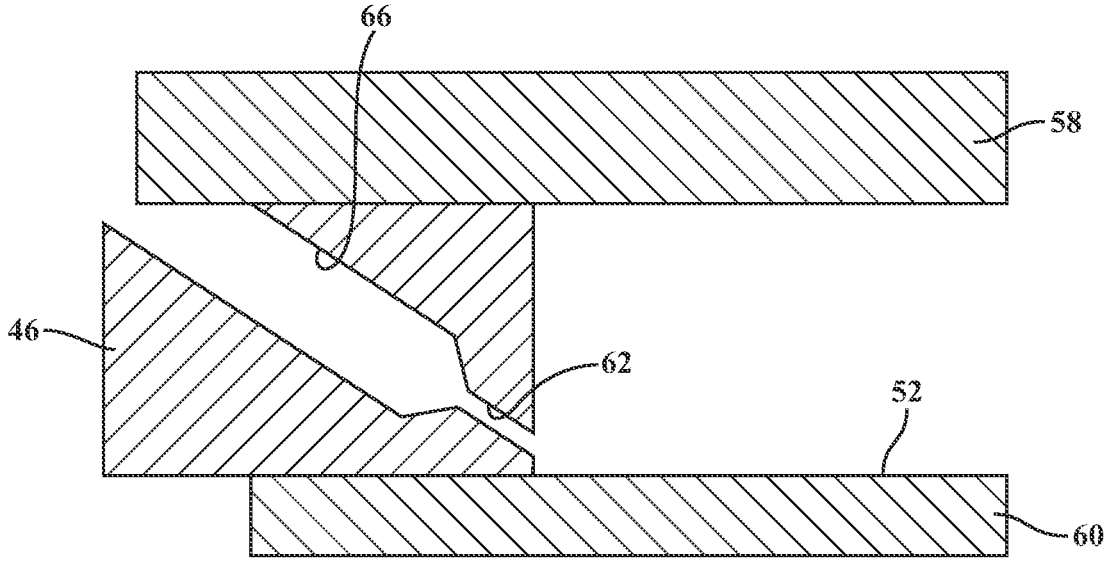
FIG. 17A is a cross-sectional view of another embodiment of the variable cam timing phaser, with the reservoir being defined by the rotor and the air vent being defined by the rotor.
Figure 17B:
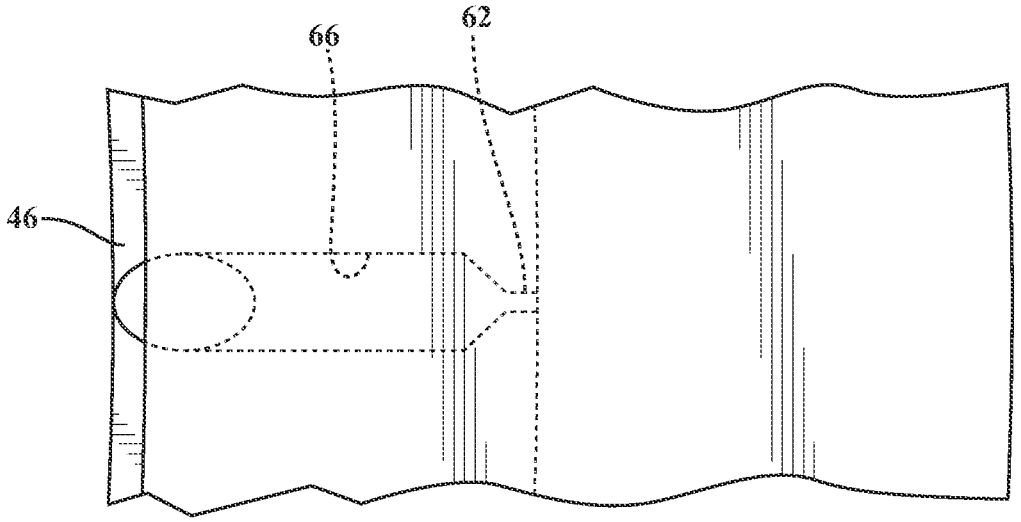
FIG. 17B is a top view of the rotor, the first end plate, the second end plate, the reservoir, and the air vent of FIG. 17A.

In yet another embodiment, as shown in FIGS. 17A and 17B, the rotor 46 defines the at least one air vent 62 and the reservoir 66.

Figure 18:
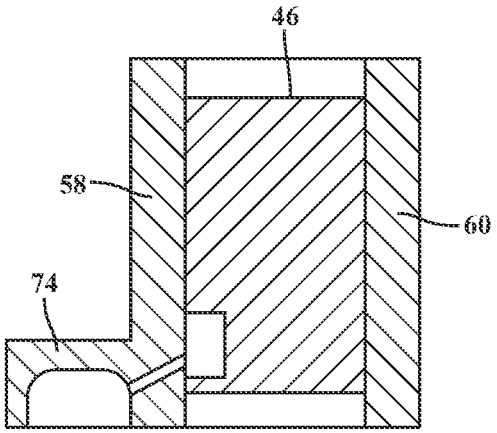
FIG. 18 is cross-sectional view of another embodiment of the variable cam timing phaser, with the first end plate having an end plate protrusion extending away from the second end plate, with the end plate protrusion defining the reservoir, and with the first end plate defining the air vent.

In another embodiment, as shown in FIG. 18, the first end plate 58 may have an end plate protrusion 74 extending away from the second end plate 60, with the end plate protrusion 74 defining the reservoir 66, and with the first end plate 58 defining the at least one air vent 62.

Figure 19:
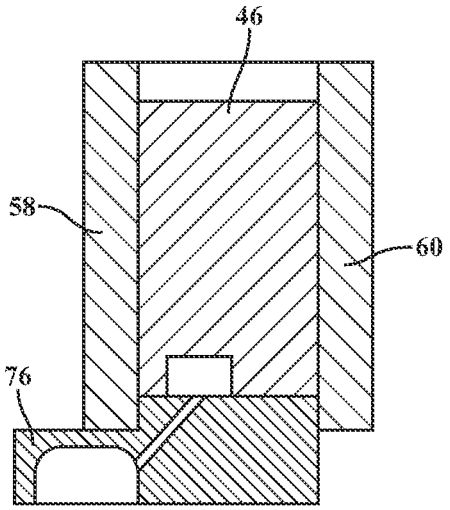
FIG. 19 is a cross-sectional view of another embodiment of the variable cam timing phaser, with the rotor having a rotor protrusion extending away from the second end plate, and with the rotor protrusion defining the reservoir and the rotor defining the air vent.

In another embodiment, as shown in FIG. 19, the rotor 46 has a rotor protrusion 76 extending away from the second end plate 60, and the rotor protrusion 76 defines the reservoir 66 and the rotor 46 defines the at least one air vent 62.

It is to be appreciated that in any of the embodiments of the reservoir 66 described above that the reservoir 66 may be defined 360 degrees about the axis A. It is also to be appreciated that in any of the embodiments of the reservoir 66 described above that the reservoir 66 may be further defined as two reservoirs, three reservoirs, four reservoirs, or more reservoirs.

As shown in FIG. 20, the variable cam timing phaser 30 may also include a control valve 78 fluidly coupled to the plurality of chambers 52 for directing hydraulic fluid to the plurality of chambers 52 to rotate the rotor 46. When present, the control valve 78 may be disposed in the housing interior 40. The control valve 78 may have a valve housing 80 defining a valve housing interior 82, with a piston 84 disposed in the valve housing interior 82. In such embodiments, the control valve 78 may be a further defined as a centerbolt such that the control valve 78 is able to fix the variable cam timing phaser 30 to the camshaft 34. In other embodiments, the control valve 78 is disposed outside of the housing interior 40, such as in an oil pressure actuated (OPA) variable cam timing phaser 30.

What is claimed is:

1. A variable cam timing phaser of a variable cam timing system, with the variable cam timing system including a camshaft, said variable cam timing phaser comprising:

a housing having a housing wall disposed about an axis and defining a housing interior, with said housing having a first housing side facing a first direction along said axis and a second housing side facing a second direction opposite said first direction;

a rotor disposed within said housing interior and moveable with respect to said housing, with said rotor having a hub and a plurality of vanes extending from said hub away from said axis toward said housing wall, and with said rotor and said housing defining a plurality of chambers with each chamber of said plurality of chambers having an advance chamber and a retard chamber;

a first end plate coupled to said first housing side and further defining said plurality of chambers;

a second end plate coupled to said second housing side and further defining said plurality of chambers;

at least one air vent located at a center of rotation region of at least one of said housing, said rotor, said first end plate, or said second end plate;

wherein said center of rotation region is defined as being relative to rotational motion of the variable cam timing phaser;

wherein air brought to said center of rotation region during use of the variable cam timing phaser and received in said at least one air vent escapes hydraulic fluid remaining in the variable cam timing phaser;

wherein said at least one air vent is fluidly coupled to said plurality of chambers and is configured to vent air from said plurality of chambers, and wherein said at least one air vent is defined by at least one of said rotor, said first end plate, said second end plate, and said housing; and a reservoir fluidly coupled to said at least one air vent, wherein said reservoir is configured to retain hydraulic fluid and is configured to reduce air from being ingested through said at least one air vent and into the plurality of chambers;

wherein said reservoir is directly fluidly coupled to said at least one air vent at a maximum radius of said reservoir from said axis, and said reservoir is directly fluidly coupled to the atmosphere at a minimum radius of said reservoir from said axis.

2. The variable cam timing phaser as set forth in claim 1, wherein said at least one air vent is fluidly coupled to said advance chamber.

3. The variable cam timing phaser as set forth in claim 2, wherein said advance chamber is further defined as a high-pressure chamber and said retard chamber is further defined as a low pressure chamber.

4. The variable cam timing phaser as set forth in claim 1, wherein said reservoir is configured to be at, or near, atmospheric pressure.

5. The variable cam timing phaser as set forth in claim 1, further comprising a ring coupled to said first end plate, wherein said ring defines said reservoir, and wherein said first end plate defines said at least one air vent.

6. The variable cam timing phaser as set forth in claim 5, wherein said reservoir has a first ring cross-sectional flow area and a second ring cross-sectional flow area, and wherein said second ring cross-sectional flow area is less than said first ring cross-sectional flow area.

7. The variable cam timing phaser as set forth in claim 5, wherein said reservoir is defined 360 degrees about said axis, wherein said at least one air vent is further defined as a plurality of air vents, and wherein said plurality of air vents is fluidly coupled to said plurality of chambers and is configured to vent air from said plurality of chambers.

8. The variable cam timing phaser as set forth in claim 1, wherein said first end plate defines said reservoir.

9. The variable cam timing phaser as set forth in claim 8, wherein said rotor defines said at least one air vent.

10. The variable cam timing phaser as set forth in claim 9, wherein said reservoir is defined 360 degrees about said axis, wherein said at least one air vent is further defined as a plurality of air vents, and wherein said plurality of air vents is fluidly coupled to said plurality of chambers and is configured to vent air from said plurality of chambers.

11. The variable cam timing phaser as set forth in claim 1, wherein said rotor and said first end plate define said reservoir.

12. The variable cam timing phaser as set forth in claim 11, wherein said first end plate defines said at least one air vent.

13. The variable cam timing phaser as set forth in claim 1, wherein said rotor defines said at least one air vent and said reservoir.

14. The variable cam timing phaser as set forth in claim 1, wherein said first end plate has an end plate protrusion extending away from said second end plate, and wherein said end plate protrusion defines said reservoir and said first end plate defines said at least one air vent.

15. The variable cam timing phaser as set forth in claim 1, wherein said rotor has a rotor protrusion extending away from said second end plate, and wherein said rotor protrusion defines said reservoir and said rotor defines said at least one air vent.

16. The variable cam timing phaser as set forth in claim 1, wherein said reservoir is defined 360 degrees about said axis.

17. The variable cam timing phaser as set forth in claim 1, further comprising a control valve fluidly coupled to said plurality of chambers for directing hydraulic fluid to the plurality of chambers to rotate said rotor.

18. The variable cam timing phaser as set forth in claim 17, wherein said control valve is disposed in said housing interior.

19. The variable cam timing phaser as set forth in claim 17, wherein the control valve is disposed outside of said housing interior.

20. The variable cam timing phaser as set forth in claim 1 being free of a check valve disposed in said at least one air vent.

21. A variable cam timing system, comprising:

a camshaft; and a variable cam timing phaser, comprising, a housing having a housing wall disposed about an axis and defining a housing interior, with said housing having a first housing side facing a first direction along said axis and a second housing side facing a second direction opposite said first direction;

a rotor disposed within said housing interior and moveable with respect to said housing, with said rotor having a hub and a plurality of vanes extending from said hub away from said axis toward said housing wall, and with said rotor and said housing defining a plurality of chambers with each chamber of said plurality of chambers having an advance chamber and a retard chamber;

a first end plate coupled to said first housing side and further defining said plurality of chambers;

a second end plate coupled to said second housing side and further defining said plurality of chambers;

at least one air vent located at a center of rotation region of at least one of said housing, said rotor, said first end plate, or said second end plate;

wherein said center of rotation region is defined as being relative to rotational motion of the variable cam timing phaser;

wherein air brought to said center of rotation region during use of the variable cam timing phaser and received in said at least one air vent escapes hydraulic fluid remaining in the variable cam timing phaser;

wherein said at least one air vent is fluidly coupled to said plurality of chambers and is configured to vent air from said plurality of chambers, and wherein said at least one air vent is defined by at least one of said rotor, said first end plate, said second end plate, and said housing; and a reservoir fluidly coupled to said at least one air vent, wherein said reservoir is configured to retain hydraulic fluid and is configured to reduce air from being ingested through said at least one air vent and into the plurality of chambers;

wherein said reservoir is directly fluidly coupled to said at least one air vent at a maximum radius of said reservoir from said axis, and said reservoir is directly fluidly coupled to the atmosphere at a minimum radius of said reservoir from said axis.

* * * * *